US006398593B1

(12) United States Patent
Yeh

(10) Patent No.: US 6,398,593 B1
(45) Date of Patent: Jun. 4, 2002

(54) CONDUCTIVE CONTACT MEMBER FOR A CABLE CONNECTOR

(76) Inventor: Ching-Shan Yeh, No. 153, I-Lin Rd., Jen-Te Hsiang, Tainan Hsien (TW)

( * ) Notice: Subject to any disclaimer, the term of this patent is extended or adjusted under 35 U.S.C. 154(b) by 0 days.

(21) Appl. No.: 09/737,526

(22) Filed: Dec. 13, 2000

(30) Foreign Application Priority Data

Aug. 21, 2000 (TW) ..... 089214519

(51) Int. Cl.[7] ..... H01R 11/09

(52) U.S. Cl. ..... 439/723; 439/852; 439/654; 439/851

(58) Field of Search ..... 439/654, 851, 439/856, 857, 578

(56) References Cited

U.S. PATENT DOCUMENTS 5,108,318 A * 4/1992 Sakurai et al. ..... 439/744
5,186,663 A * 2/1993 Wymelenberg ..... 439/843
5,220,126 A * 6/1993 Borgwath et al. ..... 89/28.05
5,667,409 A * 9/1997 Wong et al. ..... 439/654
5,863,226 A * 1/1999 Lan et al. ..... 439/852
5,865,654 A * 2/1999 Shimirak ..... 439/852
6,045,415 A * 4/2000 May et al. ..... 439/852
6,186,841 B1 * 2/2001 Jacobsson ..... 439/851
6,217,381 B1 * 4/2001 Kameyama ..... 439/578
6,250,974 B1 * 6/2001 Kerek ..... 439/843
6,264,508 B1 * 6/2001 Lehmann ..... 439/843

* cited by examiner

*Primary Examiner*—P. Austin Bradley
*Assistant Examiner*—Larisa Tsukerman
(74) *Attorney, Agent, or Firm*—Skjerven Morrill LLP

(57) ABSTRACT

A conductive contact member for a cable connector includes a tubular body and a clamping portion with a pair of diametrically opposite clamping legs extending axially and integrally from one end of the tubular body. Each clamping leg has an opening formed between opposite end portions, and a spring plate which is disposed in the opening and which has a connecting end portion connected integrally to the respective clamping leg, and a distal end portion. The spring plates are adapted for cooperatively clamping a conductive pin of a cable that is inserted into the contact member.

4 Claims, 9 Drawing Sheets

CONDUCTIVE CONTACT MEMBER FOR A CABLE CONNECTOR

BACKGROUND OF THE INVENTION

1. Field of the Invention

The present invention relates to a contact member for use in a cable connector, more particularly to a contact member for connecting cable pins of various diameters in a relatively secure manner.

2. Description of the Related Art

Referring to FIGS. 1 and 2, a conductive contact member 13 is used in a tubular cable connector 1 and is used for connecting with a conductive pin 14 of a cable. The cable connector 1 is made of a metal, such as copper, and is formed with an axial receiving space 11. The contact member 13 is sleeved by a pair of insulating sleeves 12 which are received respectively in the axial receiving spaces 11 of a pair of the cable connectors 1. The contact member 13 has two opposite contact end portions 132, and is shown to comprise an opposed pair of metal plates 130 which are formed with opposed folding lines 133 in a respective one of the contact end portions 132. The folding lines 133 in a respective one of the contact end portions 132 cooperatively serve as a clamp for clamping the cable pin 14. As such, the cable pin 14 is only in contact with portions of the metal plates 130 at the folding lines 133 when the pin 14 is inserted into the contact member 13. The electrical contact between the cable pin 14 and the contact member 13 is not quite stable. Moreover, the metal plates 130 at a respective one of the contact end portions 132 are forced outwardly when the cable pin 14 is inserted into the respective one of the contact end portions 132, and spring back inwardly when the cable pin 14 is subsequently removed from the contact member 13. The cable pin 14 typically has a diameter in the range of 0.6 to 1.0 mm. After being in contact with a cable pin of a larger diameter for a long period of time, it is very likely that the contact member 13 would be unable to clamp another cable pin of a smaller diameter in a relatively secure manner due to spring fatigue of the metal plates 130, thereby adversely affecting the signal transmission.

FIG. 3 illustrates another conventional contact member 24 for use in input and output connectors 21, 22 of a cable directional tap 2. The contact member 24 has a first end portion 242 which defines an insert hole 243 to permit insertion of a cable pin thereinto and which is enclosed by an insulating sleeve 25, and a second end portion 241 which extends through an insulating plug 25' and which is soldered to a circuit board (not shown) disposed in the cable directional tap 2. The contact member 24 is shown to comprise an opposed pair of elongated metal spring plates 240. The spring plates 240 have folding portions at the first end portions 242 of the contact member 24 and that serve as a clamp. The spring plates 240 are soldered to each other at the second end portion 241 of the contact member 24. However, repeated insertion and removal of the cable pin can weaken the solder connections between the metal plates 240, and between the second end portion 241 of the contact member 24 and the circuit board.

Referring to FIG. 4, still another conventional conductive contact member is shown to include an integral tubular body 20 having two opposite end portions. Each end portion is formed with a diametrically opposite pair of radial openings 21 and a pair of spring plates 23, 24 disposed respectively in the openings 21 and connected integrally to the tubular body 20. The spring plates 23, 24 have distal ends for cooperatively clamping a IS cable pin that is inserted into the tubular body 20. However, this type of conductive contact member still suffers from the aforementioned drawback resulting from spring fatigue of the spring plates 23, 24 after long-term connection with a cable pin of a larger cross-section.

SUMMARY OF THE INVENTION

Therefore, the main object of the present invention is to provide a contact member for use in a cable connector and for connecting cable pins of various diameters in a relatively secure manner.

Accordingly, the conductive contact member of the present invention includes a tubular body with opposite, ends, and a clamping portion which includes a pair of clamping legs extending axially from one of the opposite ends of the tubular body. The clamping legs are diametrically opposite to each other with respect to the tubular body. Each of the clamping legs has a first end portion connected integrally to said one of the opposite ends of the tubular body, a second end portion opposite to the first end portion, and an opening formed between the first and second end portions. The second end portions of the clamping legs cooperatively confine an axial insert hole adapted to permit insertion of a conductive pin of a cable thereinto. Each of the clamping legs has a spring plate disposed in the opening. The spring plate has a connecting end portion connected integrally to a respective one of the clamping legs, and a distal end portion opposite to the connecting end portion. The spring plates are adapted for cooperatively clamping the conductive pin of the cable therebetween.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
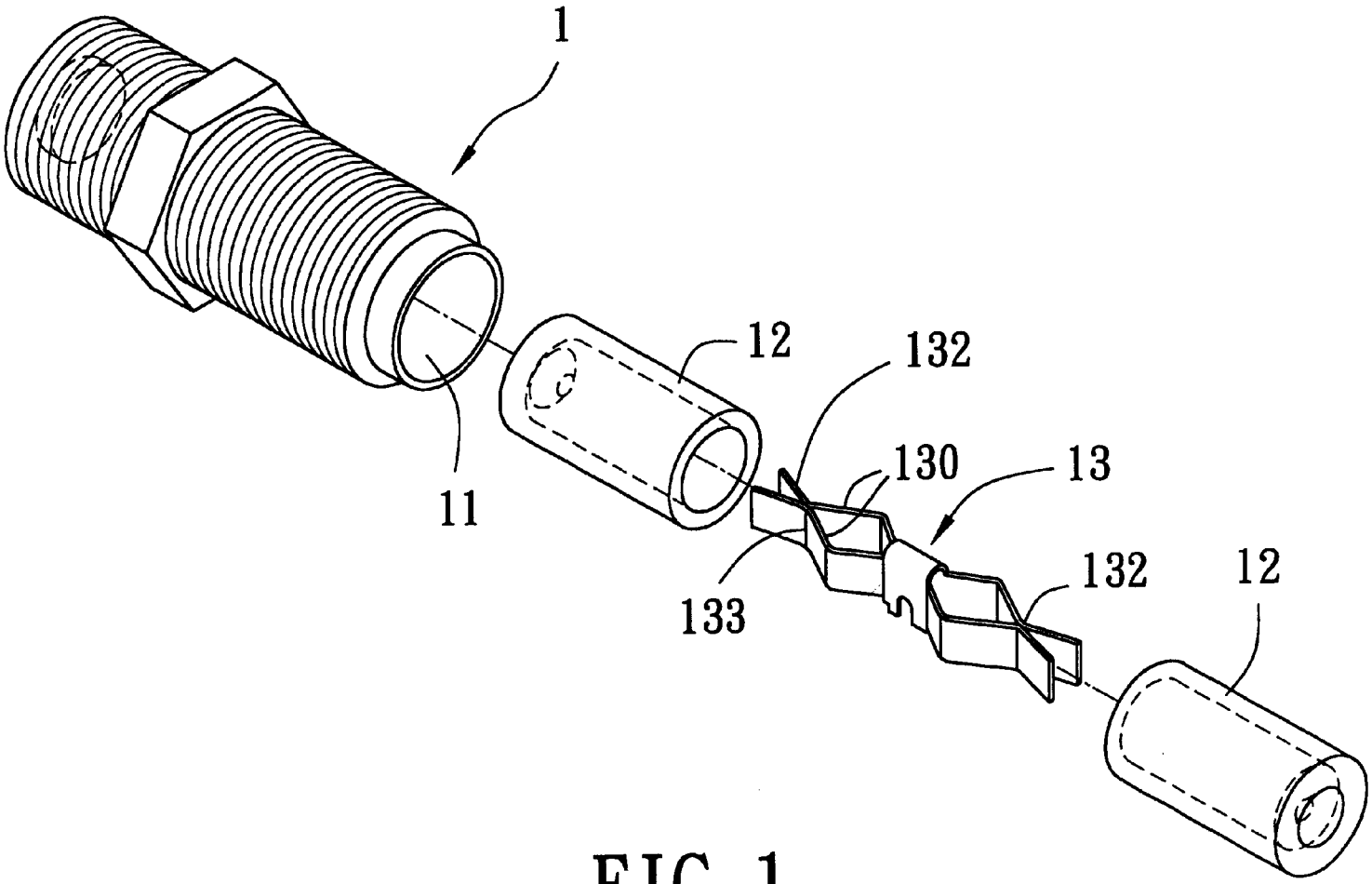
FIG. 1 PRIOR ART
FIG. 1 is an exploded perspective view illustrating a first conventional contact member for a cable connector.
Figure 2:
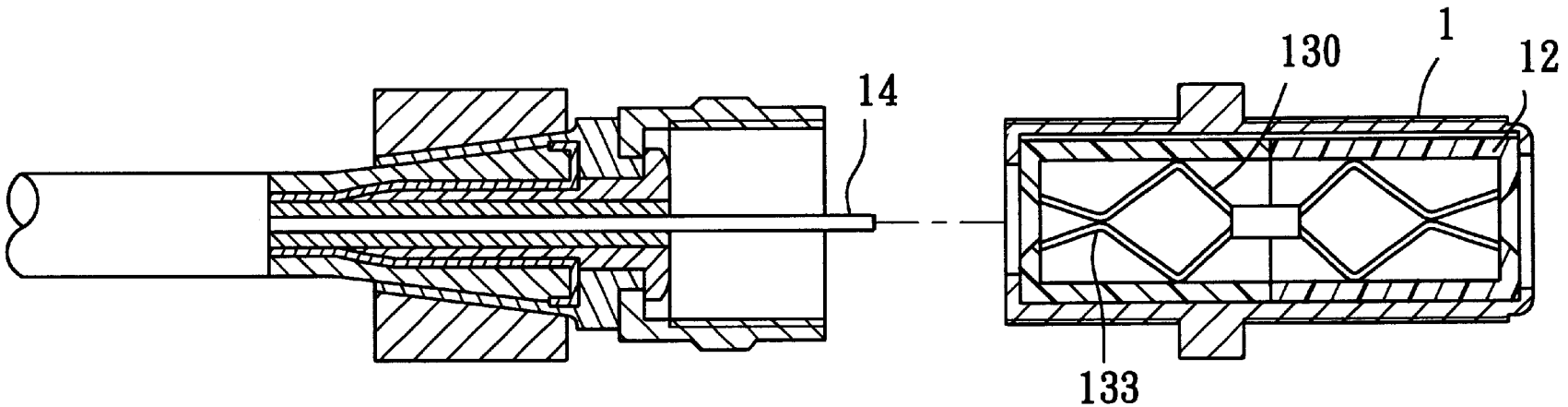
FIG. 2 PRIOR ART
FIG. 2 is a sectional view of the first conventional contact member when used with the cable connector.

Before the present invention is described in greater detail, it should be noted that like elements are denoted by the same reference numerals throughout the disclosure.

Figure 5:
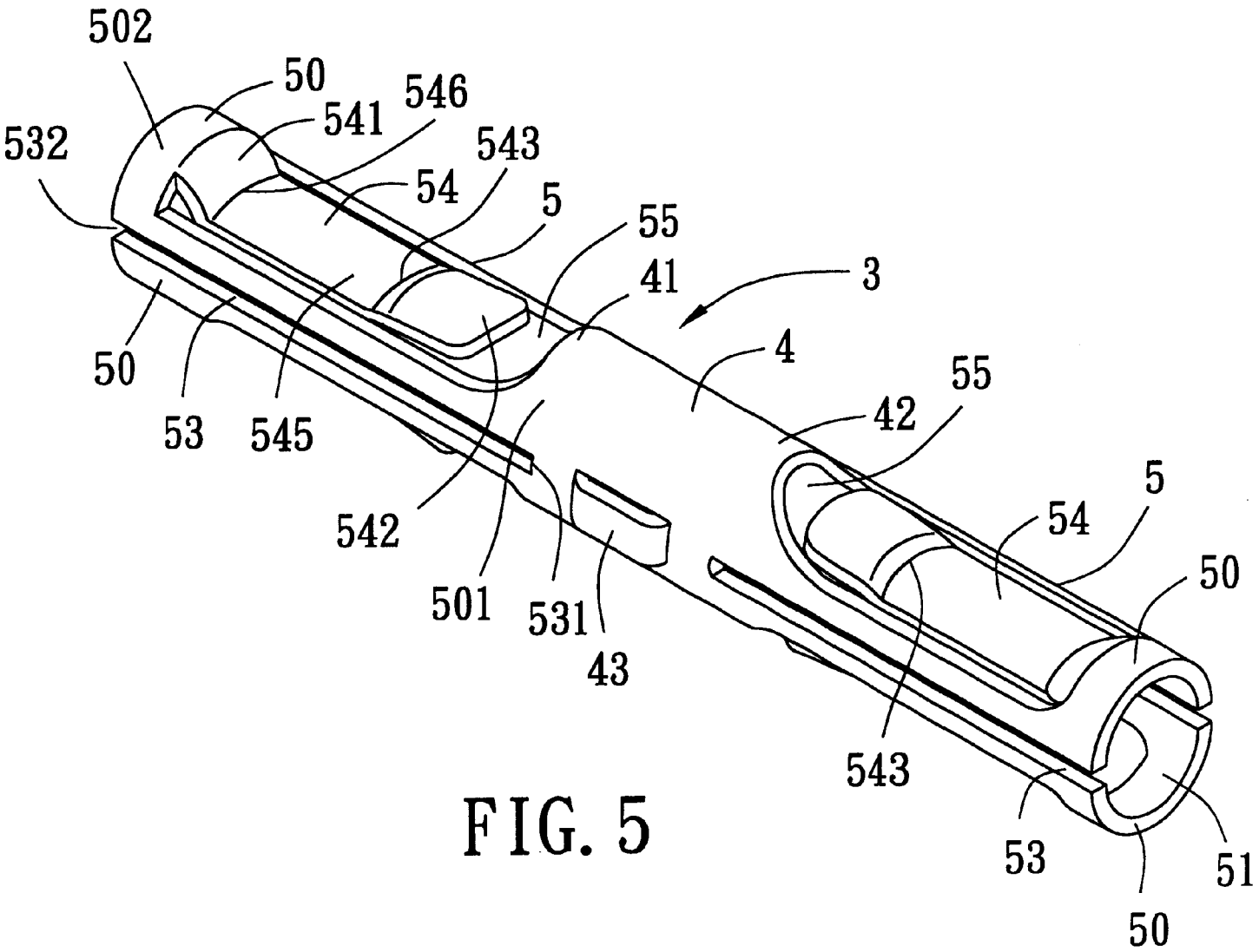
FIG. 5 is a perspective view of a first preferred embodiment of the conductive contact member according to the present invention.
Figure 6:
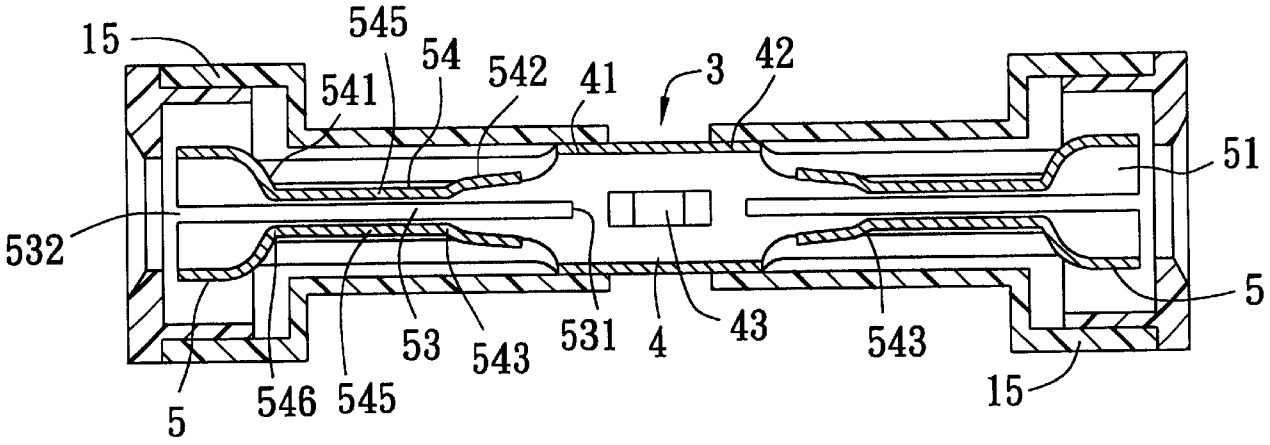
FIG. 6 is a sectional view illustrating the first preferred embodiment, where two insulating sleeves are sleeved on the conductive contact member.

Referring to FIGS. 5 and 6, the first preferred embodiment of the conductive contact member 3 of the present invention is shown to include a tubular body 4 and a pair of clamping portions 5 connected respectively to opposite ends 41, 42 of the tubular body 4. Each of the clamping portions 5 is adapted to be sleeved by an insulating sleeve 15, and is adapted to be positioned within a tubular cable connector, such as the cable connector 1 shown in FIG. 1. The tubular body 4 is formed with a pair of positioning protrusions 43 for positioning the contact member 3 between the insulating sleeves 15.

Each of the clamping portions 5 includes a pair of clamping legs 50 extending axially from the respective one of the opposite ends 41, 42 of the tubular body 4. The clamping legs 50 are diametrically opposite to each other with respect to the tubular body 4, and form a diametrically opposite pair of slits 53 therebetween. Each of the clamping legs 50 has a first end portion 501 connected integrally to the respective one of the opposite ends 41, 42 of the tubular body 4, and a second end portion 502 opposite to the first end portion 501. Each of the slits 53 extends in a direction parallel to an axis of the tubular body 4, and has a closed end 531 formed adjacent to the first end portions 501 of the clamping legs 50, and an open end 532 formed adjacent to the second end portions 502 of the clamping legs 50. The clamping legs 50 have curved cross-sections and convex outer surfaces opposite to each other. The second end portions 502 of the clamping legs 50 cooperatively confine an axial insert hole 51 communicated with an interior of the tubular body 4. The axial insert hole 51 is adapted to permit insertion of a conductive pin of a cable into the conductive contact member 3. Each of the clamping legs 50 is formed with an opening 55 between the first and second end portions 501, 502 thereof. The openings 55 in the clamping legs 50 of each of the clamping portions 5 are diametrically opposite to each other. Each of the clamping legs 50 further has a spring plate 54 disposed in the opening 55. The spring plate 54 has a connecting end portion 541 connected integrally to the second end portion 502 of the respective clamping leg 50, a distal end portion 542 proximate to the first end portion 501 of the respective clamping leg 50, and a contact portion 545 extending axially between the connecting end portion 541 and the distal end portion 542. The contact portions 545 of the spring plates 54 are disposed radially and inwardly relative to the first and second end portions 501, 502 of the clamping legs 50, and are adapted to be in contact with the cable pin for cooperatively clamping the cable pin therebetween when the cable pin is inserted into the contact member 3 via the insert hole 51. The spring plate 54 has a curved cross-section, and a concave inner surface which confronts the spring plate 54 on the other one of the clamping legs 50 and which is adapted to contact the cable pin. The connecting end portion 541 of the spring plate 54 bends radially and outwardly from the contact portion 545 so as to form a first folding line 546 between the contact portion 545 and the connecting end portion 541. The distal end portion 542 of the spring plate 54 bends radially and outwardly from the contact portion 545 such that a second folding line 543 is formed between the distal end portion 542 and the contact portion 545. The clamping legs 50 of the clamping portions 5 are formed integrally with the tubular body 4. The opening 55 in each of the clamping legs 50 and the spring plate 54 in the opening 55 are formed by punching.

Figure 7:
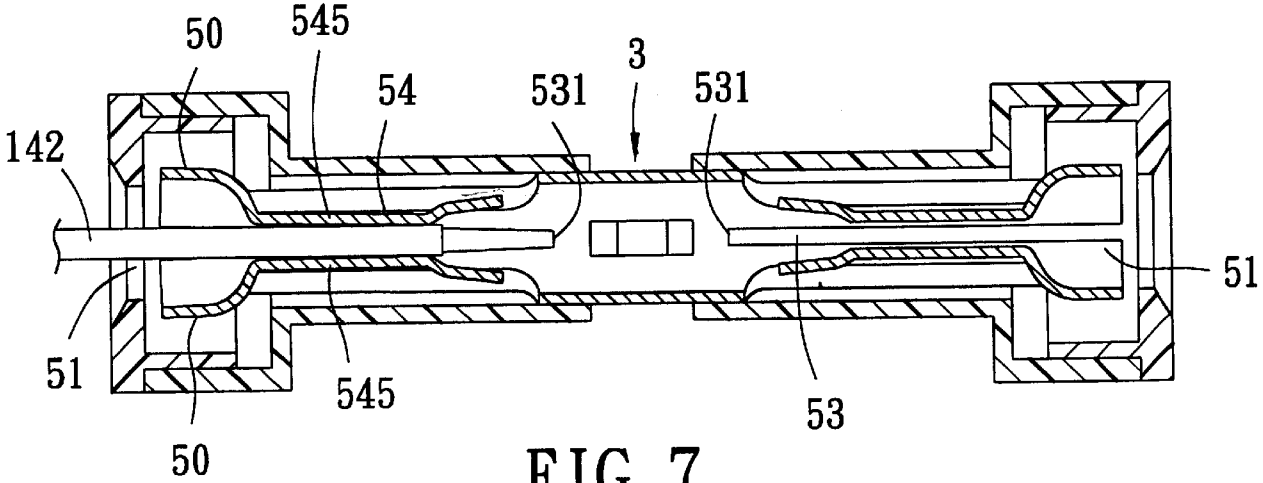
FIG. 7 is a longitudinal sectional view of the first preferred embodiment to illustrate connection with a cable pin that has a smaller cross-section.
Figure 8:
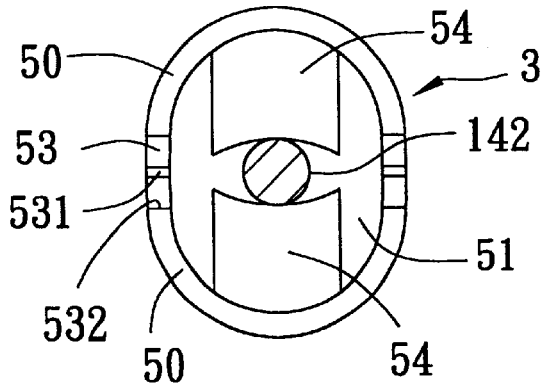
FIG. 8 is an end view of the first preferred embodiment, with the smaller sized cable pin illustrated in cross-section.

Referring to FIGS. 7 and 8, when a cable pin 142 is inserted into one of the clamping portions 5 of the contact member 3 via the insert hole 51, the spring plates 54 of the clamping legs 50 are forced radially and outwardly apart from each other so as to enable the contact portions 545 of the spring plates 54 to clamp the cable pin 142 therebetween. At this time, a stress is applied to the connecting end portions 541 of the spring plates 54.

Figure 10:
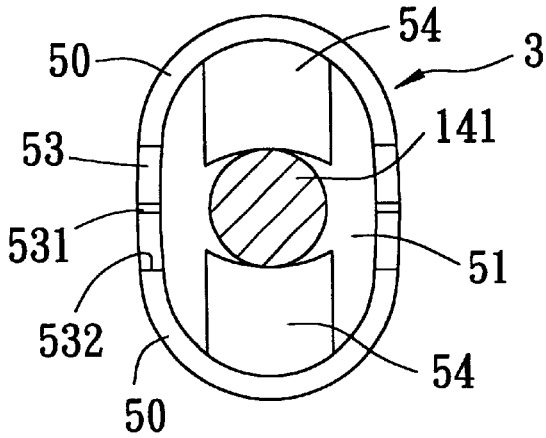
FIG. 10 is an end view of the first preferred embodiment, with the larger sized cable pin illustrated in cross-section.
Figure 9:
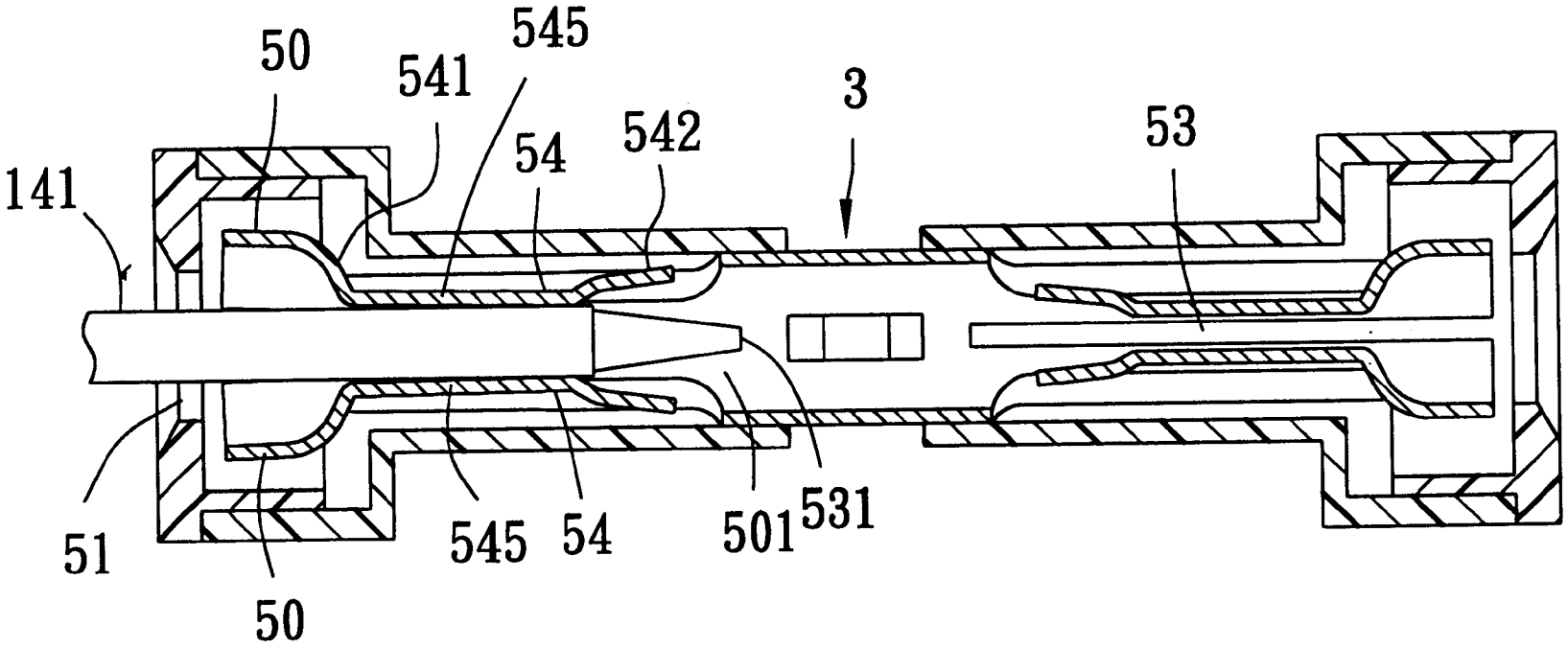
FIG. 9 is a longitudinal sectional view of the first preferred embodiment to illustrate connection with a cable pin that has a larger cross-section.

Referring to FIGS. 9 and 10, when another cable pin 141 with a larger cross-section is inserted into one of the clamping portions 5 of the contact member 3 via the insert hole 51, both the spring plates 54 and the clamping legs 50 that carry the spring plates 54 are forced radially and outwardly, and the cable pin 141 is clamped between the contact portions 545 of the spring plates 54. At this time, each of the slits 53 in the respective one of the clamping portions 5 diverges from its closed end 531 toward its open end 532. As such, the resulting stress due to insertion of the cable pin 141 is distributed among the connecting end portions 541 of the spring plates 54 and the first end portions 501 of the clamping legs 50.

It is noted that with the formation of the folding lines 546, 543 on the spring plates 54, both the strength of the spring plates 54 and the clamping effect provided by the spring plates 54 are enhanced.

Figure 3:
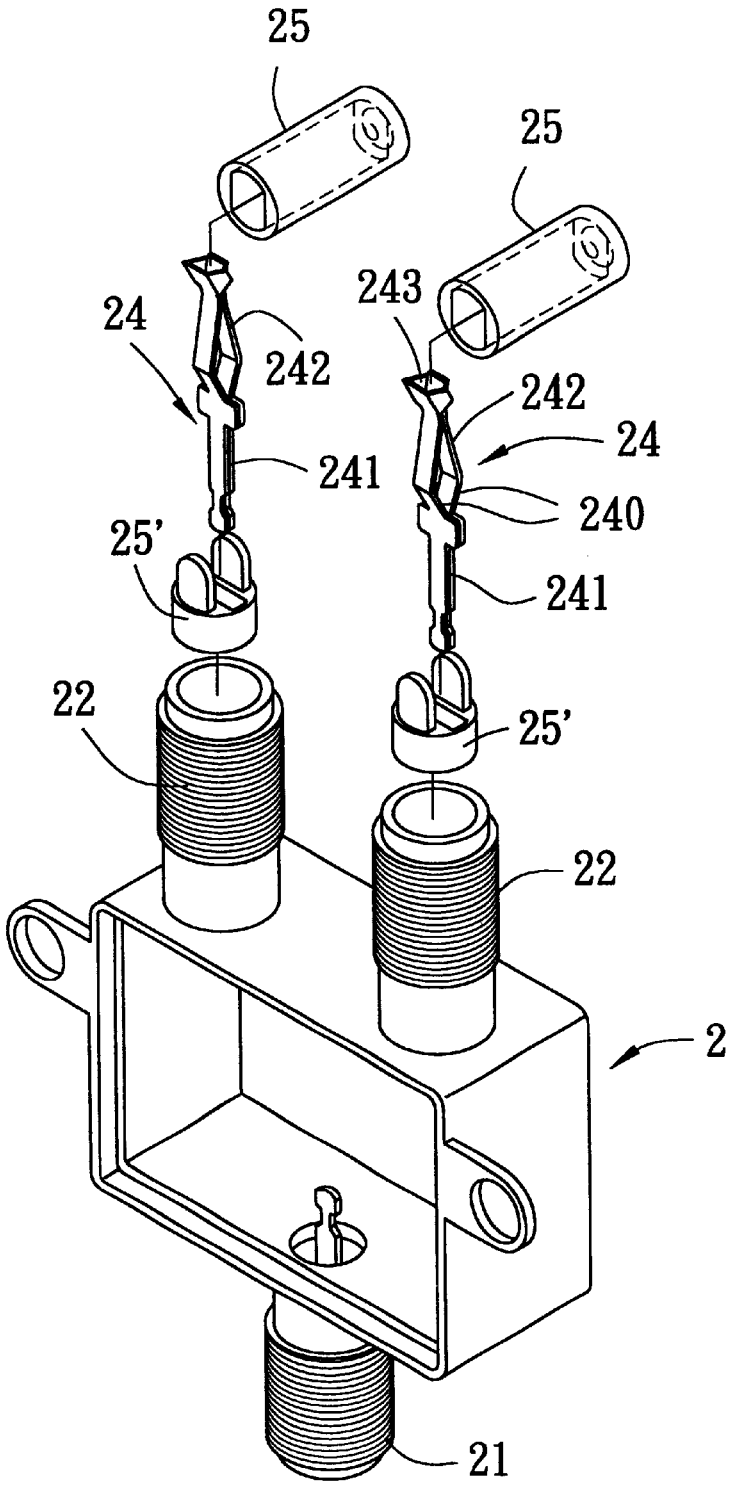
FIG. 3 PRIOR ART
FIG. 3 is an exploded perspective view illustrating a second conventional contact member for a connector of a cable directional tap.
Figure 4:
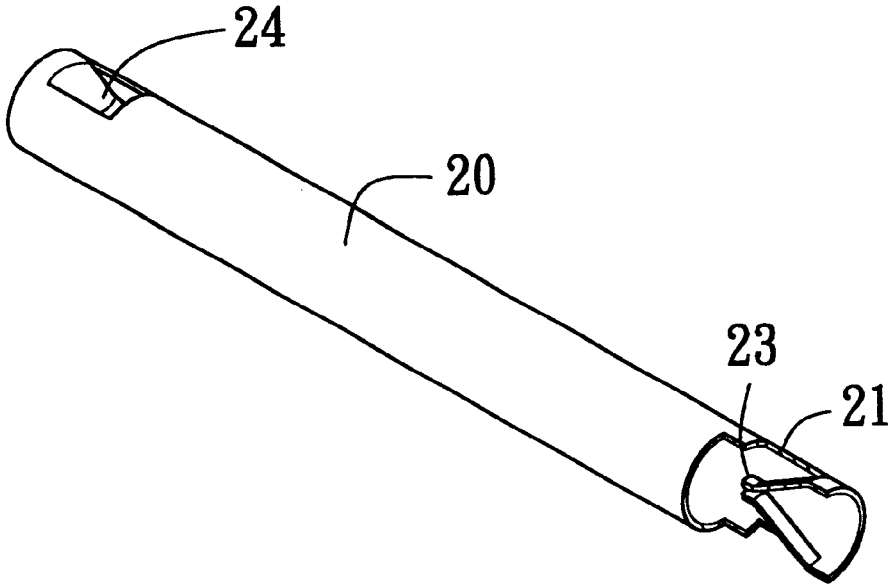
FIG. 4 PRIOR ART
FIG. 4 is a partly sectioned perspective view illustrating a third conventional contact member for a cable connector.
Figure 11:
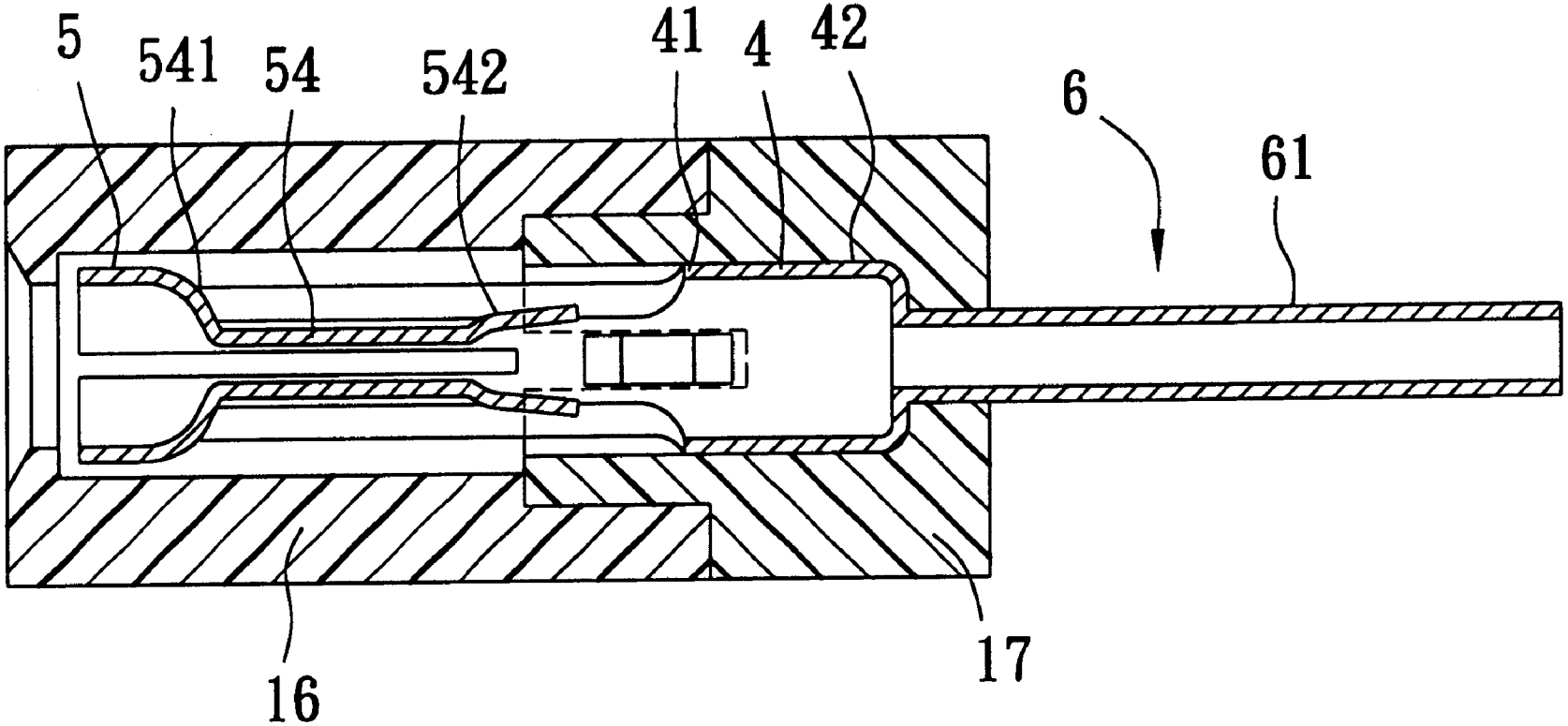
FIG. 11 is a sectional view illustrating a second preferred embodiment of the conductive contact member according to the present invention, where two insulating sleeves are sleeved on the conductive contact member.

Referring to FIG. 11, a second preferred embodiment of the conductive contact member 6 of the present invention is shown to include a tubular body 4, a clamping portion 5 connected to one end 41 of the tubular body 4, and a soldering extension 61 connected integrally to the other end 42 of the tubular body 4. The contact member 6 is adapted for use in a connector of a cable directional tap, such as the input and output connectors 21, 22 of the cable directional tap 2 shown in FIG. 3. The contact member 6 is adapted to be sleeved by an insulating sleeve 16 and an insulating plug 17 such that the soldering extension 61 extends out of the insulating sleeve 16 and the insulating plug 17. The soldering extension 61 has a cross-section smaller than the cross-section of the tubular body 4, and is adapted to be soldered to a circuit board (now shown) that is disposed in the cable directional tap. Operation of the clamping portion 5 of the conductive contact member 6 of the present embodiment is similar to that of the previous embodiment and will not be described further for the sake of brevity.

It has thus been shown that the conductive contact member 3, 6 of the present invention achieves the following advantages:

1. Since both the clamping legs 50 and the spring plates 54 are resilient, the conductive contact member 3, 6 of the present invention is suitable for clamping cable pins of different diameters. The occurrence of spring fatigue can be deferred or even prevented.
2. Since the resulting stress due to insertion of the cable pin 141, 142 can be distributed among the clamping legs 50 and the spring plates 54, the service life of the contact member 3, 6 can be prolonged.
3. The concave inner surfaces of the spring plates 54 can be in close contact with the cable pin 141, 142, thus providing a relatively stable electrical contact between the contact member 3, 6 and the cable pin 141, 142.
4. Since the contact portions 545 of the spring plates 54 extend axially, a relatively good clamping effect can be achieved thereby to prevent axial displacement of the cable pin 141, 142 when the cable pin 141, 142 is clamped in the contact member 3, 6 of the present invention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A conductive contact member for a cable connector, comprising:

a tubular body having opposite ends; and a clamping portion which includes a pair of clamping legs extending axially from one of said opposite ends of said tubular body, said clamping legs being diametrically opposite to each other with respect to said tubular body, each of said clamping legs having a first end portion connected integrally to said one of said opposite ends of said tubular body, a second end portion opposite to said first end portion, and an opening formed between said first and second end portions, said second end portions of said clamping legs cooperatively defining an axial insert hole adapted to permit insertion of a conductive pin of a cable thereinto, said clamping legs having formed therebetween a pair of diametrically opposite slits, each of said slits extending in a direction parallel to an axis of said insert hole, and having a closed end formed adjacent to said first end portions of said clamping legs, and an open end formed adjacent to said second end portions of said clamping legs;

each of said clamping legs having a spring plate disposed in said opening, said spring plate having a connecting end portion connected integrally to said second end portion of a respective one of said clamping legs, a distal end portion opposite to said connecting end portion and proximate to said first end portion of the respective one of said clamping legs, and a contact portion between said connecting and distal end portions;

said connecting end portion extending inclinedly, radially and inwardly from said second end portion of the respective one of said clamping legs to said contact portion relative to the axis of said insert hole so as to form a first folding line between said contact portion and said connecting end portion;

said contact portion extending substantially parallel to the axis of said insert hole, and having a curved clamping surface which confronts said contact portion of said spring plate of the other one of said clamping legs, said curved clamping surfaces of said contact portions of said spring plates of said clamping legs being adapted to establish planar contact with and cooperatively clamp the conductive pin of the cable;

said distal end portion extending inclinedly, radially and outwardly from said contact portion toward said first end portion of the respective one of said clamping legs relative to the axis of said insert hole so as to form a second folding line between said contact portion and said distal end portion.

2. The conductive contact member as claimed in claim 1, wherein said opening and said spring plate are formed by punching.

3. The conductive contact member as claimed in claim 1, further comprising a soldering extension extending integrally from the other one of said opposite ends of said tubular body, said soldering extension having a cross-section smaller than cross-section of said tubular body.

4. The conductive contact member as claimed in claim 1, comprising a pair of said clamping portions which are connected respectively to said opposite ends of said tubular body.

* * * * *